United States Patent [19]

Sunohara

[11] Patent Number: 4,548,838

[45] Date of Patent: Oct. 22, 1985

[54] METHOD FOR MASKING IN PAINTING PROCESS AND MASKING TOOL THEREFOR

[75] Inventor: Akira Sunohara, Hiratsuka, Japan

[73] Assignee: Nissan Shatai Company, Limited, Hiratsuka, Japan

[21] Appl. No.: 654,463

[22] Filed: Sep. 26, 1984

[30] Foreign Application Priority Data

Sep. 28, 1983 [JP] Japan ..... 58-179936
Mar. 12, 1984 [JP] Japan ..... 59-35186[U]

[51] Int. Cl.[4] ..... B05D 5/00; B05D 1/32; B05C 17/08

[52] U.S. Cl. ..... 427/282; 118/505

[58] Field of Search ..... 118/505, 301, 406; 427/282

[56] References Cited

U.S. PATENT DOCUMENTS 3,192,896 7/1965 Irving ..... 118/505

4,411,219 10/1983 Keith et al. ..... 118/505

*Primary Examiner*—Evan K. Lawrence

*Attorney, Agent, or Firm*—Schwartz, Jeffery, Schwaab, Mack, Blumenthal & Evans

[57] ABSTRACT

In a masking technique used in painting processes, a flexible masking sheet is held in place and in shape by the tension on wires fixed to the sheet. The tension is generated by a tensioning device which acts as a ratchet allowing only increases in tension at room temperature and which loses ratcheting effect at higher temperatures. The tensioning device may employ a wax-actuated clutch which is rigid at room temperature but which gradually loses rigidity, thus slowly releasing tension, as temperature increases. Alternatively, the tensioning device may remain perfectly rigid until a higher temperature prevails. A workpiece can be masked and painted at room temperature and then cured and/or dried at a higher temperature, at which time the mask can be easily removed.

13 Claims, 19 Drawing Figures

METHOD FOR MASKING IN PAINTING PROCESS AND MASKING TOOL THEREFOR

BACKGROUND IN THE INVENTION

The present invention relates generally to a method for masking in a painting process and a masking tool therefor. In particular, the invention relates to a masking method and tool useful in the automotive industry and the like for performing multi-color painting of vehicle components, particularly components made of synthetic resin.

Published Japanese Patent Application (Tokkai) No. 58-114764, published on July 8, 1983 discloses a masking method utilizing a flexible sheet. A pair of wires with resiliently expandable hook are provided along the longitudinal edges of the flexible sheet. A vehicle component to be painted, such as a resin bumper, is mounted on and secured to a painting base. The masking sheet is fitted onto the portion of the component not to be painted by means of the wires and hooks, with the latter engaging the painting base. Tension is applied to the sheet by resilient force of the hooks.

This masking method is especially useful when the component to be painted is made of resin and therefore expansile during heating or baking in an oven or heating booth of a painting shop. Since the masking method provided by the applicant's prior invention uses a flexible sheet and relatively flexible wires, the mask can be adapted to any shape or any curved portion of the component. In addition, a sharp border between the painted portion and the unpainted portion can be obtained by applying sufficient tension to the mask to achieve a tight fit with the componnt to be painted. A further advantage provided by the applicant's prior invention is that since the mask can be used repeatedly, the cost for masking is reduced.

On the other hand, this masking method is subject to difficulty in releasing the mask after completion of the painting process due to the tension of the resilient hooks. For instance, when the mask is to be released from the component, the resilient hooks are first disengaged from the painting base. At this moment, due to the accumulated resilient force, the mask may be abruptly dragged along the surface of the painted component and injure the border between the painted and unpainted portions. This reduces the overall yield of the painting process. Furthermore, as will be naturally appreciated, selecting an appropriate resilient force for the resilient hook may present some difficulty. The mask must have a relatively low tension to conform to thermal deformation of the resin component which tends to expand when heated. On the other hand, a relatively high tension force is required to ensuring masking and obtain a sharp painting border.

SUMMARY OF THE INVENTION

Therefore, it is an object of the present invention to resolve the aforementioned problem in the applicant's prior invention and provide an improved and more useful masking method and tool.

Another and more specific object of the invention is to provide a masking method which allows easy release of the mask and flexibility in selecting tension force to be applied to the mask.

In the principle of the present invention, the mask will loosen during heating or baking processes. This reduction in the tension is achieved by a heat-responsive means which gradually reduces the tension as the temperature increases. By gradually reducing the tension on the mask, inadvertent displacement of the mask can be prevented while obtaining sharp painting edges before the thermo-active steps of the painting process. In addition, the heat-dependent reduction in tension allows the mask to conform to thermal deformation of the component.

BRIEF DESCRIPTION OF THE DRAWINGS

The present invention will be understood more fully from the detailed description given herebelow and from the accompanying drawings of the preferred embodiments which, however, should not be taken to limit the invention to the specific embodiments but are for explanation and understanding only.

In the drawings.

DESCRIPTION OF THE PREFERRED EMBODIMENT

The following description concerns a mask for a bumper made of synthetic resin such as urethan, which is to be painted more than one color. However, it should be appreciated that the masking technique disclosed here is applicable not only to automotive bumpers but to anything to be painted to have more than one color. Furthermore, the masking technique according to the invention is applicable to any painting processes requiring masking.

Figure 1:
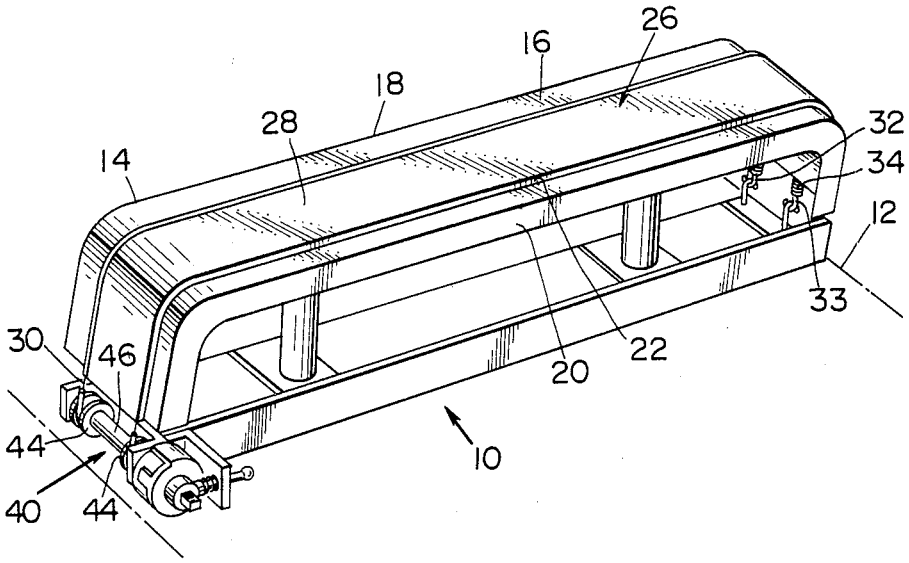
FIG. 1 is a perspective view of a bumper resting on a bumper retainer, to which the preferred embodiment of masking device according to the present invention is applied.

Referring to FIG. 1, a bumper retainer 10 may be detachably or rigidly secured on a conveyer 12. The retainer 10 acts as a sort of perch for a urethane bumper 14. As can be seen from FIGS. 1 and 2, the bumper has a stepped and grooved front surface 16 and upper and lower sections 18 and 20 which are essentially horizontal when mounted on the vehicle. Parallel grooves 22 are formed along the longitudinal edges of the front surface. The bumper 14 rests on a head (not shown) of the retainer 10 such that its front surface 16 faces upward.

Figure 2:
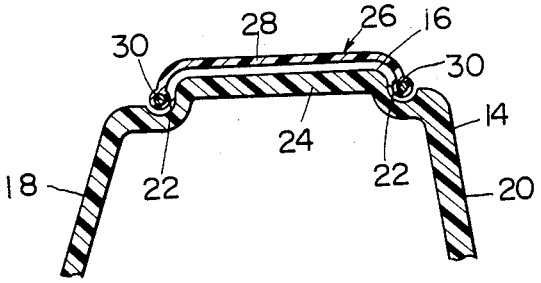
FIG. 2 is a cross-section of the bumper for which the first embodiment of masking is applied.
Figure 3:
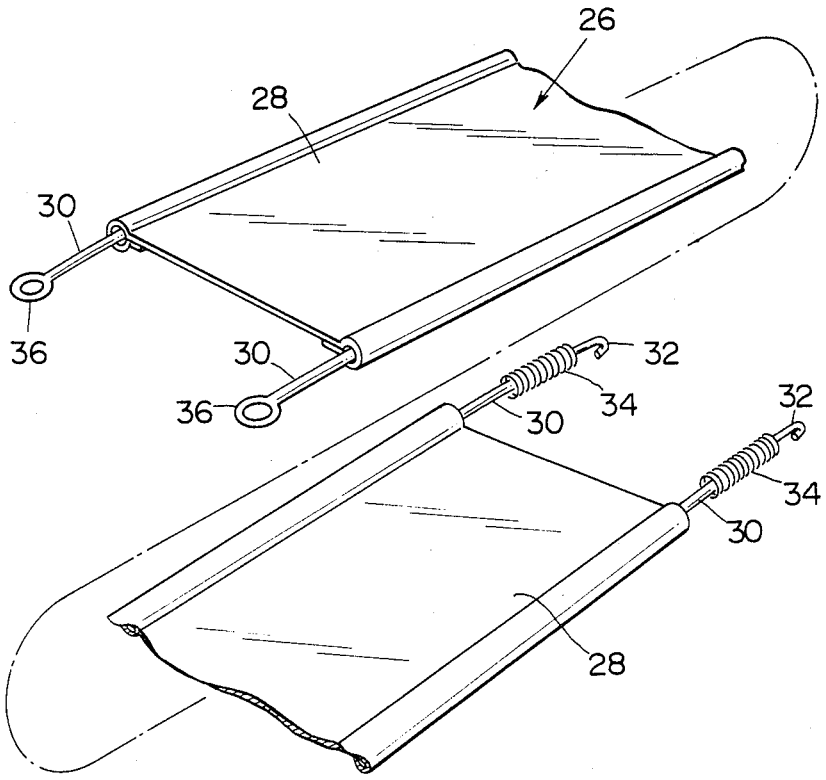
FIG. 3 is a perspective view of part of a mask employed in the first embodiment of masking.

Assuming the section 24 on the front surface 16 is to be painted a different color than the remainder, a mask 26 is applied over the section 24 while the remaining sections are painted. As shown in FIGS. 1 and 3, the mask 26 comprises a flexible, heat-resistant sheet 28 and wires 30. The wires 30 extend along the parallel longitudinal edges of the flexible sheet 28. Each wire 30 has a hook 32 at one end. The hook 32 may be connected to the wire 30 by means of a tension spring 34 to apply some tension to the wire. The other end of the wire 30 has a hook or loop 36 intended to engage a tensioner 40 incorporated in the retainer 10, which will be described in detail later. In this example, the width w of the mask 26 is selected to correspond to the width of the section 24 of the front surface. When the mask 26 is applied to the bumper, the wires 30 fit into the grooves 22, as shown in FIG. 2.

Figure 4:
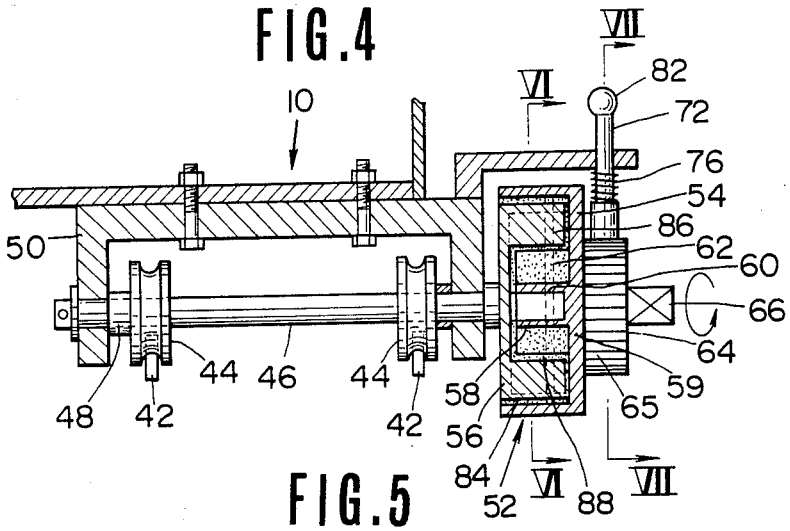
FIG. 4 is a cut-away view of the tensioner of the first embodiment of masking device.
Figure 5:
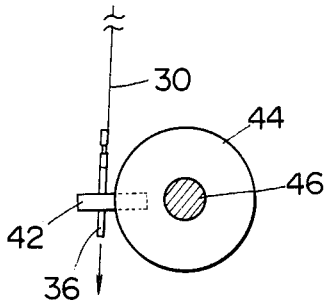
FIG. 5 is a cross-section of a tension roller in the masking device of FIG. 4.

Each hook or loop 36 engages a hooking projection 42 formed on the outer periphery of a corresponding tension roller 44, as shown in FIGS. 1, 4 and 5. The tension rollers 44 are fixed to a rotary shaft 46. One end of the rotary shaft 46 is rotatably connected to a bearing 48 fixed to a base frame 50 of the retainer 10. The other end of the rotary shaft 46 is connected to a clutch mechanism 52. In the shown embodiment, a wax-based clutch mechanism 52 is used.

Figure 6:
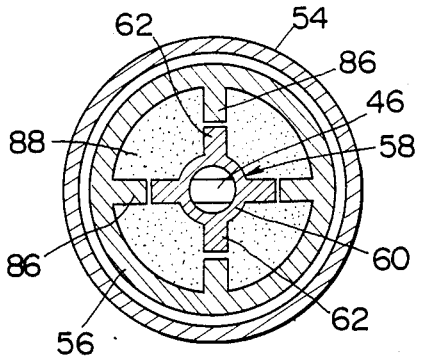
FIG. 6 is a cross-section taken along line VI—VI of FIG. 4.
Figure 8:
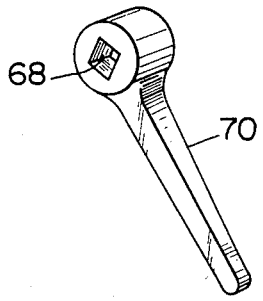
FIG. 8 is a perspective view of a grip handle employed in the first embodiment of masking device of FIG. 4.

As shown in FIG. 6, the clutch mechanism 52 generally comprises an outer drum 54 and an inner drum 56 which are concentrically arranged. The outer drum 54 has a central projection 58 attached to its outer ring by an end plate 59. The central projection 58 has a cylindrical section 60 and radial sections 62 extending radially symmetrically from the outer periphery of the cylindrial section 60. The outer drum 54 also has a ratchet wheel 64 having ratchet teeth 65 on the outer periphery fixed on the end plate opposite the central projection 58. A square shaft 66 projects from the ratchet wheel 64. The square shaft 66 is engageable with a square opening 68 in a grip handle 70, which is shown in FIG. 8. A stopper lever 72 has an edged end 74 opposing the peripheral ratchet teeth 65 of the ratchet wheel 64. The stopper lever 72 is biased toward the ratchet wheel by means of a coil spring 76 wound about its shaft. The stopper level 72 extends through an opening 78 in a section 80 of the frame 50 and that end forms a handle grip 82.

The inner drum 56 is fixed to the rotary shaft 46 for rotation therewith. A seal 84 is provided between the outer periphery of the inner drum 56 and the inner periphery of the outer drum 54 in order to establish a leak-proof seal therebetwen. The inner drum 56 has radial extensions 86 extending radially inwards from its inner periphery. The inner ends of the radial extensions 86 oppose corresponding ends of radial sections 62 of the central projection of the outer drum. The space 88 defined between the inner and outer drums 56 and 54 is filled with a wax which remains solid at temperatures below a known melting temperature.

In the preferred embodiment, the wax resists rotational torques applied through the inner drum 56 up to approximately 50 kg.cm in the temperature range of 22° C. to 23° C. At temperatures of about 80° C., the resistance drops to 2 kg.cm. The resistance of the wax gradually decreases as the temperature increases. In comparison, the tension applied to the mask 26 in the initial stage is approximately 15 kg for each wire, which corresponds to 30 kg.cm of rotational torque on the wax.

Therefore, under normal, relatively low-temperature circumstances, the wax exerts sufficient resistance to the rotational torque applied to the rotary shaft. On the other hand, when the bumper resting on the retainer is transferred into a heating oven and heated, the resistance of the wax gradually decreases in equilibrium with the rotational torque on the rotary shaft. As set forth above, since the resistance of the wax drops to approximately 2 kg.cm at 80° C., the rotational torque on the rotary shaft at that temperature will be approximately 2 kg.cm. Thus, the mask can be easily released without degrading the sharp color border.

When fitting the mask onto the bumper, first the hooks 32 of the wire 30 are engaged to openings or hooks 33 in the retainer 10. Thereafter, the hooks 36 are brought into engagement with the hooking projections 42 of the tension rollers 44. In this state, the tension rollers 44 are rotated by means of the rotary shaft 46. In order to rotate the rotary shaft, the grip handle 70 is fitted onto the square shaft 66 extending from the ratchet wheel. The ratchet wheel 64 and the outer drum 54 of the clutch mechanism 52 rotate in response to counterclockwise rotational force as viewed in FIG. 5. Since the wax is currently solid enough to provide sufficient resistance, the inner drum 56 rotates according to rotation of the outer drum 54.

Figure 7:
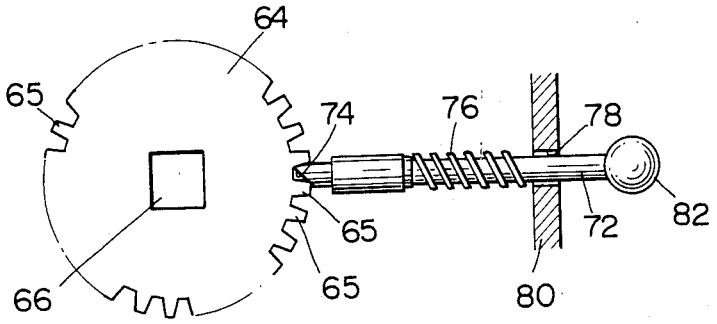
FIG. 7 is a cross-section taken along line VII—VII of FIG. 4.

The stopper lever 72 engages each the ratchet tooth of the ratchet wheel as they pass due to resilient force of the coil spring 76. As shown in FIG. 7, each ratchet tooth of the ratchet wheel 46 is biassed to allow counterclockwise rotation and to prevent clockwise rotation by engagement with the stopper lever 72. Therefore, after completion of manual rotation, the rotary shaft 46 with the tension rollers 44 is retained in the rotated position.

The point at which further rotation of the tension rollers 44 is prevented is so selected that the wires 30 are stretched with sufficient tension to hold the mask tight enough to obtain sharp boundaries between the colored portions.

The retainer supporting the masked bumper is then transferred through various painting stages including a painting booth at which paint is actually applied. After passing through the painting booth, the retainer with the painted bumper is fed into a heat oven to dry the paint. During the heating process, the wax melt gradually whereby the tension on the mask also drops gradually, as set forth above.

Figure 9:
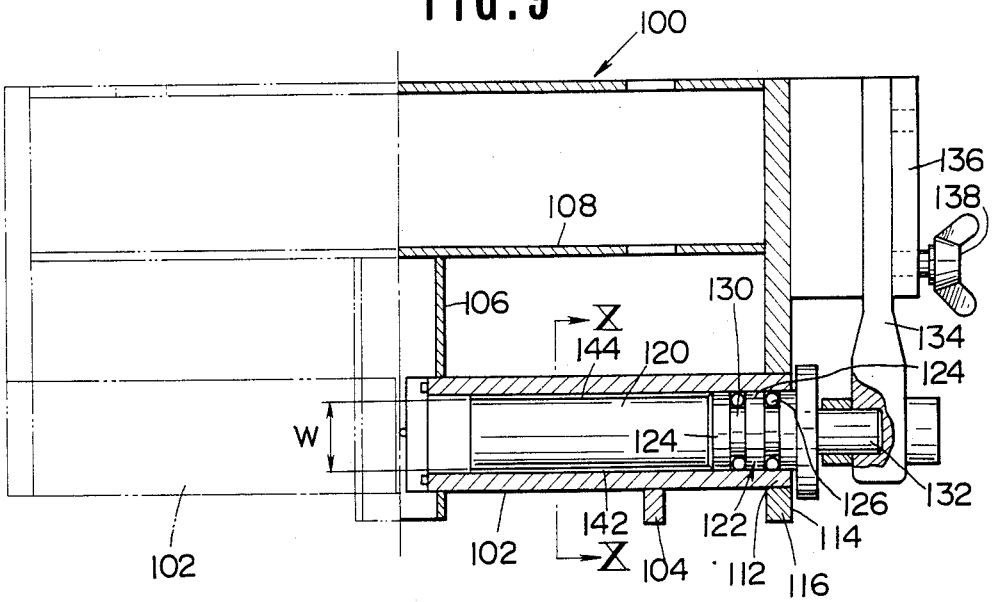
FIG. 9 is a partial section of a modification of the first embodiment of the invention.
Figure 10:
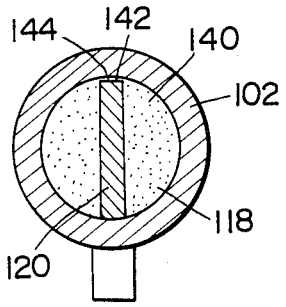
FIG. 10 is a cross-section taken along line X—X of FIG. 9.
Figure 11:
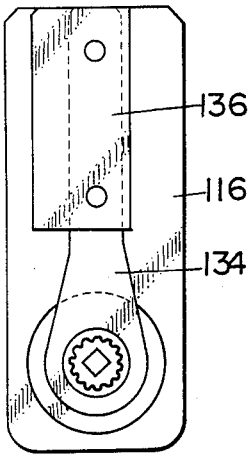
FIG. 11 is a side view of the masking device of FIG. 10.

FIGS. 9 to 11 show a modification of the aforementioned first embodiment of the masking technique according to the present invention. In this embodiment, a retainer 100 has a pair of hollow rotary shafts 102 provided coaxially on opposite sides of the retainer 100.

Each rotary shaft 102 has a hooking projection 104 extending from the outer periphery thereof. Inner end of each rotary shaft 102 engages a bracket 106 extending from the base 108 of the retainer 100 through a bearing 110. On the other hand, the outer end 112 of the rotary shaft 102 is rotatably received in an opening 114 in the outer edge 116 of the base frame 108.

As shown in FIGS. 9 to 11, the rotary shafts 102 are hollow. A clutch plate 120 with a stepped circular shaft section 122 is inserted into the interior 118 of each shaft 102. The circular shaft section 122 comprises a few larger-diameter lands 124 defining grooves 126 accommodating sealing rings 128 designed to snugly engage interior walls, in conjunction with a smaller-diameter section 130 extending outside of the interior 118. The free end 132 of the smaller diameter section 130 engages a ratchet wrench 134, which may be a torque wrench, which applies a predetermined rotational torque to the clutch plate 120. The wrench 134 is retained by means of a bracket 136 and a retainer screw 138 engaging the bracket 136.

The interior 118 of rotary shaft 102 is filled with wax 140. As in the first embodiment, the wax is solid at normal room temperature in which case it exerts sufficient resistance to rotational torque applied to the rotary shaft through the wire to hold the shaft in place.

In the preferred embodiment, the width W of the plate 120 is slightly smaller than the inner diameter of the rotary shaft 102 so that clearances 142 of about 0.5 mm are formed between the peripheral edges 144 of the plate and the opposing inner periphery of the rotary shaft.

As in the first embodiment, the wax softens as the temperature increases thus losing resistance to the rotational torque. The rotary shaft 102 rotates slowly in the clockwise direction as the resistance of the wax decreases, thus gradually decreasing the tension on the masking. According to the shown modification, since the tension on the wires 30 is provided by rotation of the rotary shafts 102 which are independently rotatable the tension on the mask 26 as a unit may be adjusted to be asymmetrical in special cases by adjusting the tension on the individual wires.

The ratchet wrench may be rotated counterclockwise as viewed in FIG. 11 to apply a predetermined torque to the rotary shaft via the clutch plate 120, and then freely rotated clockwise so as to be retained by the backet 136, as shown in FIGS. 9 and 11.

Figure 12:
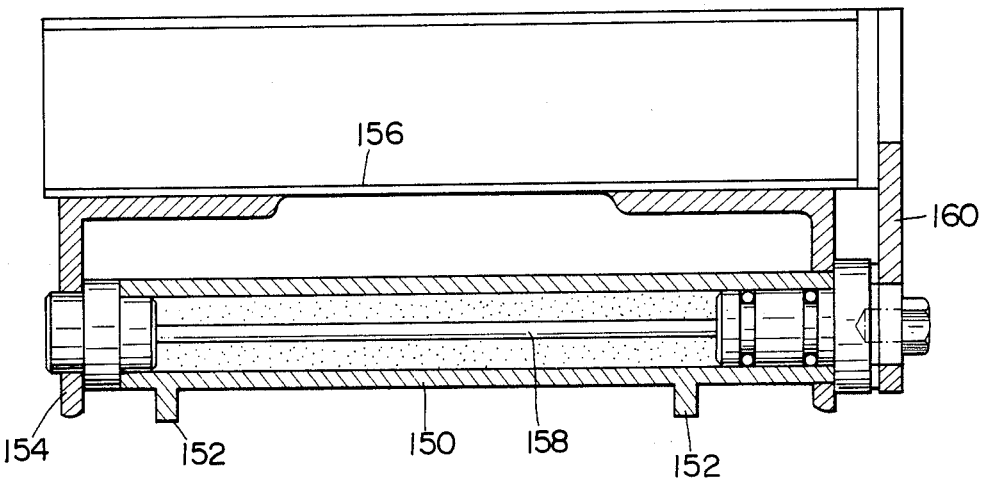
FIG. 12 is a view similar to FIG. 10 but showing another modification of the first embodiment of the masking device according to the present invention.

FIG. 12 shows another modification of the first embodiment of the painting technique according to the present invention. According to this modification, a single hollow cylindrical rotary shaft 150 is used to apply tension to the mask 26. A pair of hooking projections 152 extend from the outer periphery of the rotary shaft 150. One end of the shaft 150 is rotatably received by a bracket 154 extending from the base frame 156. The other end is rotatably received by a bracket 156. A clutch plate 158 is inserted within the hollow space 158 within the shaft and projects out through the other end of the shaft. The outer end of the clutch plate 158 is associated with a torque wrench 160 in a manner similar to that described respect to the system illustrated in FIGS. 9 to 11.

With this modification, substantially the same effects as provided by the first embodiment can be obtained.

Figure 13:
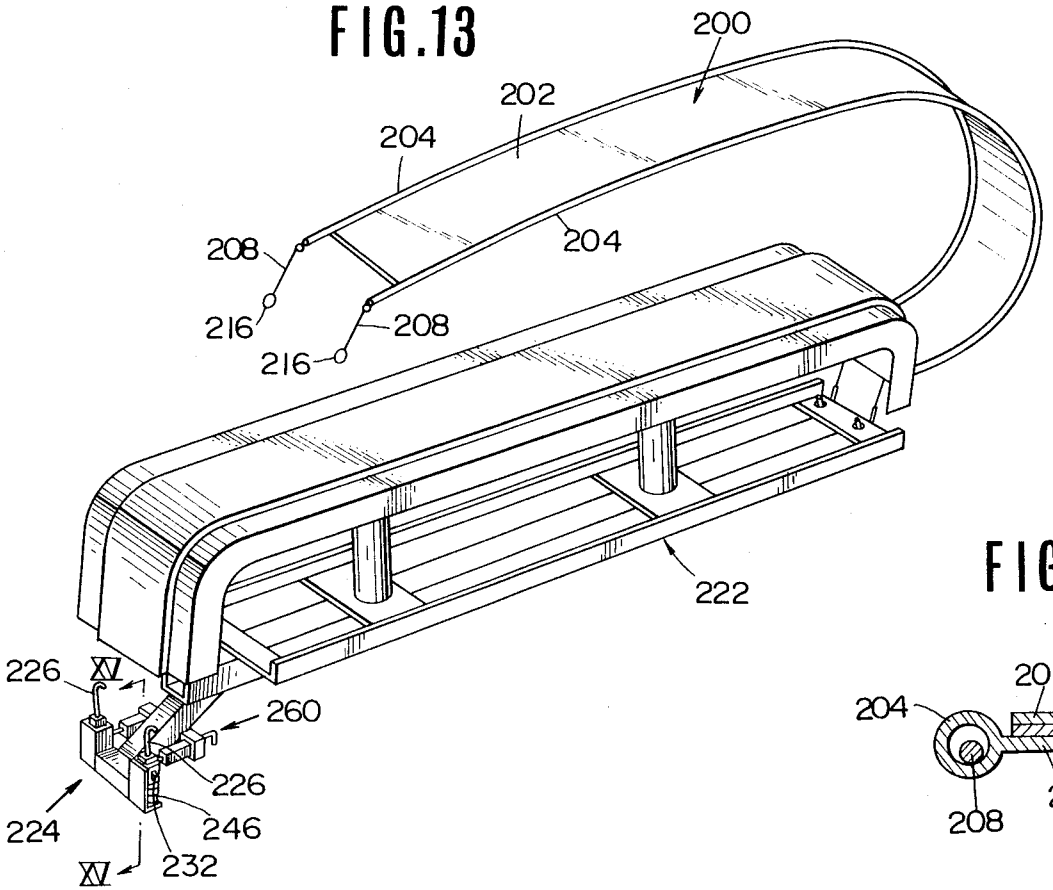
FIG. 13 is a perspective view of the retainer supporting a bumper to which the second embodiment of a masking device is applied.
Figure 14:
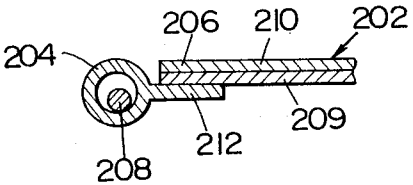
FIG. 14 is an enlarged cross-section of part of a mask employed in the second embodiment of masking device of FIG. 13.

FIGS. 13 to 20 show the second embodiment of a masking technique according to the present invention. According to this second embodiment, the mask 200 comprises a masking sheet 202, a hollow resin tubes 204 fixed to the longitudinal edges 206 of the sheet, and wires 208 extending through the tubes 204 as shown in FIG. 14. The masking sheet 202 has a base sheet 209 made of laminated layers of a synthetic resin such as polypropylene and paper. The base sheet 208 is coated with a coating film 210 made of a synthetic resin such as polypropylene. This masking sheet 202 exhibits good air permeability in order to prevent brooming on the portion painted black.

The tube 204 has an attachment tongue 212 by which the tube is fixed to the masking sheet 202. The wire 208 has hooks 214 and 216 at both ends. The hook 214 engages an opening 218 formed in the base frame 220 of a bumper retainer 222. The hook 216 is engageable with a hooking mechanism 224 of the retainer 222.

Figure 15:
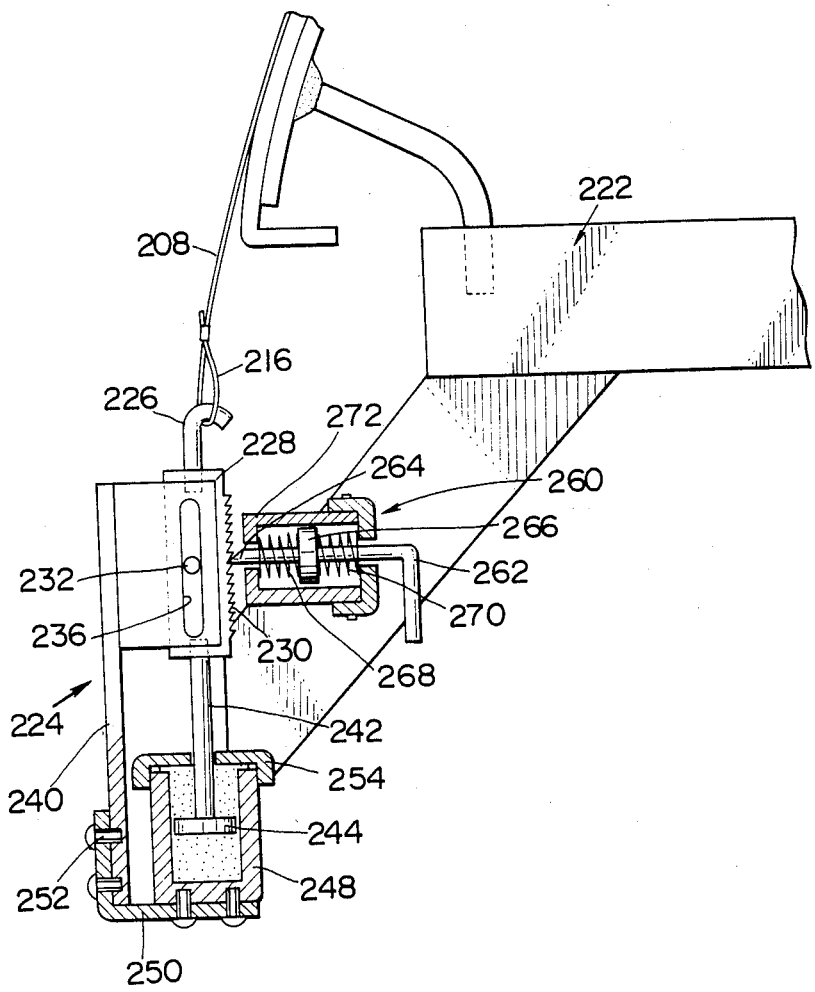
FIG. 15 is an enlarged view in partion section taken along line XV—XV of FIG. 13.
Figure 16:
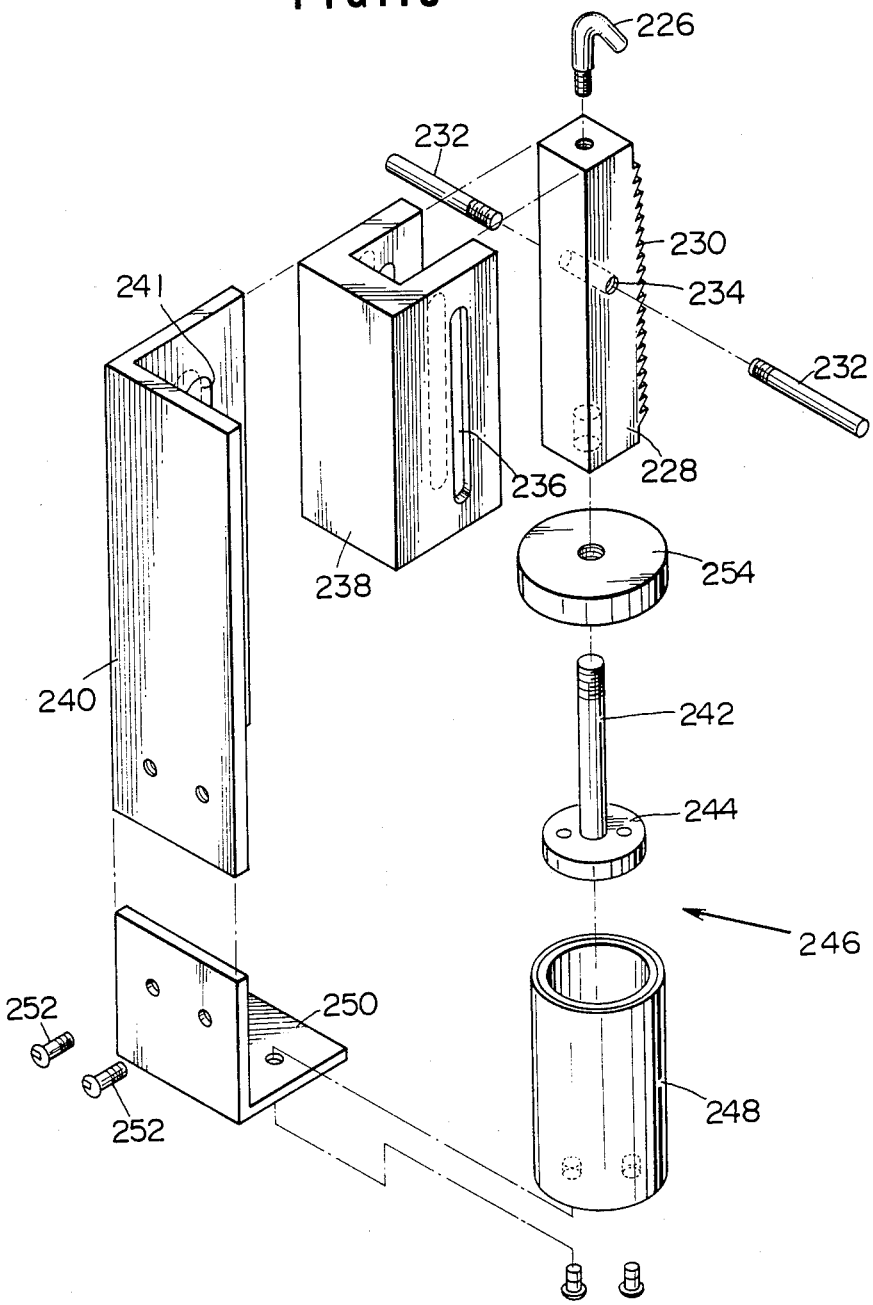
FIG. 16 is an exploded perspective view of a tensioner mechanism in the second embodiment of the masking device of FIG. 13.

As shown in FIGS. 15 and 16, the hooking mechanism 224 comprises a hook 26 screwed into a ratchet member 228 which has ratchet teeth 230 directed so as to allow downward movement of the ratchet member and prevent the ratchet member from moving upwards. A pair of guide pins 232 are screwed into threaded openings 234 in opposites sides of the ratchet member 228. The guide pins 232 movably engage elongated openings 236 formed in a guide block 238. The guide block 238 is fixed to the base frame 220 by means of a bracket 240. The bracket 240 has an elongated opening 241 opposing one of the openings 236 which allows one of the guide pins 232 to pass through. A piston rod 242 of a piston 244 of a hydraulic damper 246 is also screwed into the ratchet member 228. The piston 244 is inserted into a damper cylinder 248 which is fixed to a bracket 250. The bracket 250 is fixed to the bracket 240 by means of fixing screws 252. The top of the damper cylinder 248 is closed by a closure cap 254. The piston rod 242 extends through the closure cap 254. The damper cylinder 248 is filled with a working fluid which absorbs shocks which may result when the tension on the wires is released.

A stopper mechanism 260 is mounted rigidly on the retainer 222 at a point opposite the ratchet teeth of the ratchet member 228. The stopper mechanism 260 comprises a stopper 262 with a stopper pawl 264. The stopper is in the form of an L-shaped shaft with a circular disc 266 fixed halfway along one leg. Coil springs 268 and 270 are seated on opposite sides of the disc 266. The other ends of the coil springs 268 and 270 seat within a housing 272 which also limits the motion of stopper 262 by surrounding the disc 266 while allowing the shaft to extend out through aligned holes in the housing. The coil springs 268 and 270 are made of a shape-memory alloy. The coil springs 268 and 270 are so balanced as to bias the stopper 262 toward the ratchet member 228 under normal, relatively low-temperature conditions such as at room temperature and to increase the spring force of the spring 268 and/or lower the spring force of the spring 270 so as to lower the biasing force on the stopper 228 as temperature increases. By reducing the biasing force applied to the stopper 228, the stopper is allowed to separate from the ratchet member and thus allow upward movement of the latter, thereby reducing the tension on the wires.

Figure 17:
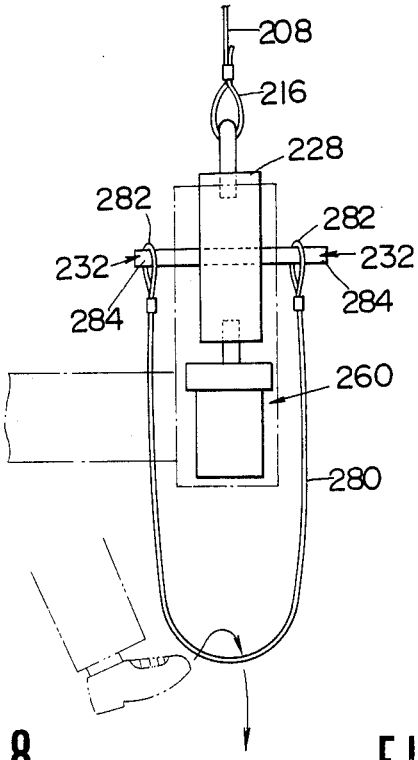
FIG. 17 is a diagram of how the mask may be attached to a bumper with a predetermined tension.

In order to exert a sufficiently high initial tension on the mask, a wire or the like 280 with loops 282 at both ends is hooked over the free ends 284 of the guide pins 232. The worker then pulls the wire 280 and the ratchet member 228 down with his foot, as shown in FIG. 17. When downward force applied by the worker's foot is released, the ratchet teeth of the ratchet member 228 engage the pawl 264 of the stopper 262 to retain the ratchet member in its downwardly-shifted position. Since the hook 226 is fixed to the ratchet member 228, the hook is thus retained in the lowered position to provide tension on the wires 208 of the mask 200.

It should be noted that, although the coil springs 268 and 270 made of shape-memory alloy are used to provide temperature-dependent restraining characteristics for the masking device, the springs are not limited to the coil configuration but alternatively can be leaf springs or other appropriate forms. In addition, although the shown embodiment employs a coil spring 268 made of shape-memory alloy which stiffens as temperature increases, it is possible to employ a spring 270 made of shape-memory alloy which relaxes as temperature increases, or both spring may be made of shape-memory alloy. In this case, the rate of change of tension should be so selected as to reduce the tension on the mask gradually.

Figure 18:
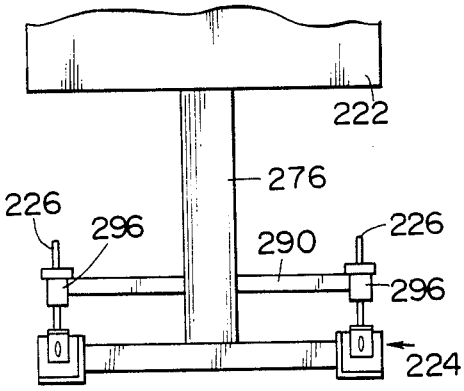
FIGS. 18 and 19 show different ways of mounting the masking device on the retainer.
Figure 19:
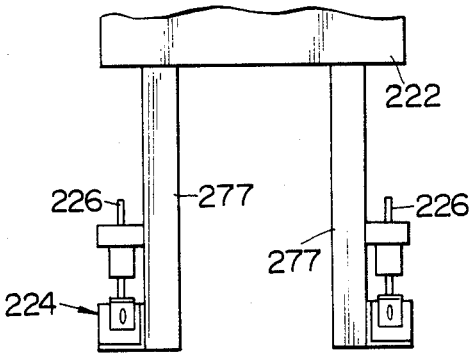

FIGS. 18 and 29 show modified methods of installation of the masking device of FIG. 13. In the modification of FIG. 18, a support frame 290 extends from a support post 276 fixed to the retainer 222. The support frame 290 has a guide 296 for guiding the vertical movement of the hook 226. On the other hand, according to the modification of FIG. 19, a pair of support posts 277 allow independent mounting of the hooking mechanisms.

According to the shown embodiment, since the ratchet member can move upwards upon reduction of the spring force applied to the stopper while the retainer with the bumper is heated in a heating oven, the mask can be easily released without damaging the color borders.

Although specific embodiments have been described hereabove, the invention may be embodied in many ways and the shown embodiments can be modified to achieve the same effects or advantages sought by the invention. Such embodiments and modifications of the shown embodiments are to be regarded as within the scope of the appended claims.

What is claimed is:

1. A masking device for an industrial painting process comprising:

a masking sheet along the lateral edges of which resilient wires are rigidly secured, said wires having first and second hooks at opposite ends thereof;

a support for supporting a workpiece to be painted, said support having a first end engageable to said first hooks of said wires, and a second end;

first means, provided at said second end of said support, for exerting tension on said wires to retain said masking sheet firmly onto the workpiece; and second means, associated with said first means and responsive to ambient temperature, for reducing said tension, as temperature increases, at a rate of change dependent upon the rate of increase in ambient temperature.

2. The device as set forth in claim 1, wherein said first means comprises an actuation means for pulling said wire in order to achieve said tension, a latching means associated with said actuation means for latching the latter at its actuated position, and a clutch means interposed between said actuation means and said latching means for controlling the degree of coupling therebetween.

3. The device as set forth in claim 2, wherein said second means is associated with said clutch means of said first means for reducing said degree of coupling to allow said actuation means to return to its initial position irrespective of said latching means, whereby the tension on said wires is released.

4. The device as set forth in claim 4, wherein said second means comprises a wax having a relatively low melting point.

5. The device as set forth in claim 4, wherein said actuation means comprises a rotary shaft engageable to said second hooks of said wires via a pair of hooks, said shaft being rotatable to said actuated position.

6. The device as set forth in claim 4, wherein said actuation means comprises a pair rotary shafts, each of which is engageable to a corresponding second hook of said wires, said rotary shafts being independently rotatable to said actuated position.

7. The device as set forth in claim 6, wherein each of said rotary shafts acts in conjunction with an independent second means.

8. The device as set forth in claim 1, wherein said first means comprises an actuation means associated with said second hook and movable to an actuated position in which it exerts tension on said wires, and a latching means associated with said actuation means for applying a latching force to said actuation means so as to retain same in said actuated position.

9. The device as set forth in claim 8, wherein said second means is associated with said latching means for reducing said latching force as temperature increases to allow said actuation means to return to its initial position.

10. The device as set forth in claim 9, wherein said second means a resilient biasing means of said latching means made of a shape-memory alloy and determining said latching force.

11. The device as set forth in claim 1, which further comprises a damper associated with said wire for damping abrupt changes in the tension on said wires.

12. The device as set forth in claim 10, which further comprises a damper associated with said wire for damping abrupt changes in the tension on said wire.

13. A method of masking and unmasking a workpiece to be painted, comprising the steps of:

fitting a flexible mask over the workpiece;

applying tension to the mask in such a way as to cover the portions of the workpiece not to be painted;

holding the tension on the mask under known, relatively low temperature conditions;

painting the workpiece;

heating the environment around the workpiece and mask;

allowing the tension on the mask to decrease in accordance with increases in temperature above said known temperature; and removing the mask from the workpiece.

* * * * *